US012031758B2

(12) United States Patent
Takahashi et al.

(10) Patent No.: US 12,031,758 B2
(45) Date of Patent: Jul. 9, 2024

(54) RELAY UNIT AND AIR-CONDITIONING APPARATUS INCLUDING THE SAME

(71) Applicant: Mitsubishi Electric Corporation, Tokyo (JP)

(72) Inventors: Hiroki Takahashi, Tokyo (JP); Yuji Motomura, Tokyo (JP); Sara Tsujimoto, Tokyo (JP); Hiroki Washiyama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 200 days.

(21) Appl. No.: 17/798,245

(22) PCT Filed: Apr. 20, 2020

(86) PCT No.: PCT/JP2020/017033

§ 371 (c)(1),
(2) Date: Aug. 8, 2022

(87) PCT Pub. No.: WO2021/214822

PCT Pub. Date: Oct. 28, 2021

(65) Prior Publication Data

US 2023/0145285 A1 May 11, 2023

(51) Int. Cl.

| | |
|---|---|
| ***F25B 41/40*** | (2021.01) |
| ***F25B 13/00*** | (2006.01) |
| ***F25B 41/20*** | (2021.01) |

(52) U.S. Cl.

CPC ..... *F25B 41/40* (2021.01); *F25B 13/00* (2013.01); *F25B 41/20* (2021.01); *F25B 2313/003* (2013.01); *F25B 2313/006* (2013.01)

(58) Field of Classification Search

CPC .. F25B 2313/006; F25B 25/005; F25B 41/40; F25B 41/00; F24F 3/06; F24F 3/08

See application file for complete search history.

(56) References Cited

U.S. PATENT DOCUMENTS

2008/0135636 A1 6/2008 Sakai et al.
2012/0000553 A1 1/2012 Matsuura et al.
(Continued)

FOREIGN PATENT DOCUMENTS

CN 203702533 U 7/2014
EP 1906107 A1 4/2008
(Continued)

OTHER PUBLICATIONS

Office Action dated Apr. 18, 2023 issued in corresponding JP Patent Application No. 2022-516478 (and English translation).
(Continued)

*Primary Examiner* — Lionel Nouketcha
(74) *Attorney, Agent, or Firm* — Posz Law Group, PLC

(57) ABSTRACT

A relay unit includes: a heat medium heat exchanger; a casing; a first refrigerant pipe connection port connected to one of two refrigerant pipes through which refrigerant circulates between the heat medium heat exchanger and the heat source side unit; a second refrigerant pipe connection port connected to an other of the refrigerant pipes; a first heat medium pipe connection port connected to one of two heat medium pipes through which a heat medium circulates between the heat medium heat exchanger and the load side unit; and a second heat medium pipe connection port connected to an other of the heat medium pipes. The first refrigerant pipe connection port, the second refrigerant pipe connection port, the first heat medium pipe connection port, and the second heat medium pipe connection port are provided on a top surface of the casing and face in a direction opposite to a direction of gravity.

9 Claims, 12 Drawing Sheets

(56) References Cited

U.S. PATENT DOCUMENTS

| | | | | |
|---|---|---|---|---|
| 2013/0199231 | A1* | 8/2013 | Morimoto | F25B 13/00 62/238.7 |
| 2016/0084547 | A1 | 3/2016 | Nishioka et al. | |
| 2020/0309411 | A1 | 10/2020 | Ukibune et al. | |
| 2020/0309419 | A1 | 10/2020 | Kumakura et al. | |
| 2020/0309437 | A1 | 10/2020 | Kumakura et al. | |
| 2020/0332166 | A1 | 10/2020 | Kumakura et al. | |
| 2020/0333041 | A1 | 10/2020 | Itano et al. | |
| 2020/0333049 | A1 | 10/2020 | Kumakura et al. | |
| 2020/0333051 | A1 | 10/2020 | Kumakura et al. | |
| 2020/0339856 | A1 | 10/2020 | Itano et al. | |
| 2020/0340714 | A1 | 10/2020 | Itano et al. | |
| 2020/0362215 | A1 | 11/2020 | Kumakura et al. | |
| 2020/0378662 | A1 | 12/2020 | Itano et al. | |
| 2020/0386459 | A1 | 12/2020 | Itano et al. | |
| 2020/0392389 | A1 | 12/2020 | Itano et al. | |
| 2020/0393175 | A1 | 12/2020 | Asano et al. | |
| 2020/0393176 | A1 | 12/2020 | Asano et al. | |
| 2021/0003323 | A1 | 1/2021 | Kumakura et al. | |
| 2021/0095897 | A1 | 4/2021 | Kumakura et al. | |
| 2021/0163804 | A1 | 6/2021 | Kumakura et al. | |
| 2021/0164698 | A1 | 6/2021 | Ohtsuka et al. | |
| 2021/0164701 | A1 | 6/2021 | Ohtsuka et al. | |
| 2021/0164703 | A1 | 6/2021 | Kumakura et al. | |

FOREIGN PATENT DOCUMENTS

| | | | |
|---|---|---|---|
| JP | 2000-104940 | A | 4/2000 |
| JP | 2005-326090 | A | 11/2005 |
| JP | 2010-281552 | A | 12/2010 |
| JP | 2012-013273 | A | 1/2012 |
| JP | 2014-163657 | A | 9/2014 |
| JP | 2017-096574 | A | 6/2017 |
| JP | 2010-107162 | A | 5/2020 |
| WO | 2007/004460 | A1 | 1/2007 |
| WO | 2014/192139 | A1 | 12/2014 |
| WO | 2019/124409 | A1 | 6/2019 |

OTHER PUBLICATIONS

Extended European Search Report dated May 12, 2023 issued in corresponding European Patent Application No. 20932739.4.

International Search Report of the International Searching Authority mailed Jun. 23, 2020 in corresponding International Patent Application No. PCT/JP2020/017033 (with English translation).

* cited by examiner

RELAY UNIT AND AIR-CONDITIONING APPARATUS INCLUDING THE SAME

CROSS REFERENCE TO RELATED APPLICATION

This application is a U.S. national stage application of PCT/JP2020/017033 filed on Apr. 20, 2020, the contents of which are incorporated herein by reference.

TECHNICAL FIELD

The present disclosure relates to a relay unit configured to exchange heat between refrigerant and a heat medium and to an air-conditioning apparatus including the relay unit.

BACKGROUND ART

A known air-conditioning apparatus includes an outdoor unit, an indoor unit, and a heat medium relay unit provided between the outdoor unit and the indoor unit (see, for example, Patent Literature 1). A primary heat medium circulates between the outdoor unit and the heat medium relay unit. A secondary heat medium circulates between the indoor unit and the heat medium relay unit. The heat medium relay unit exchanges heat between the primary heat medium and the secondary heat medium.

CITATION LIST

Patent Literature

Patent Literature 1: International Publication No. 2014/192139

SUMMARY OF INVENTION

Technical Problem

In the case of the heat medium relay unit disclosed in Patent Literature 1, refrigerant pipes through which the primary heat medium circulates between the outdoor unit and the heat medium relay unit and heat medium pipes through which the secondary heat medium circulates between the indoor unit and the heat medium relay unit are attached to respective sides of a casing of the heat medium relay unit. Accordingly, to extend these pipes in an upward direction of the casing of the heat medium relay unit, it is necessary to temporarily extend the pipes in respective sideward directions of the casing and thereafter extend the pipes in the upward direction, thus resulting in an increase in the pipe length.

The present disclosure has been made to solve such a problem and an object thereof is to provide a relay unit configured to prevent pipes to be connected thereto from being lengthened and an air-conditioning apparatus including the relay unit.

Solution to Problem

A relay unit according to an embodiment of the present disclosure is a relay unit to be connected between a heat source side unit and a load side unit and includes: a heat medium heat exchanger that is to be connected to the heat source side unit via refrigerant pipes and that is to be connected to the load side unit via heat medium pipes; a casing containing the heat medium heat exchanger; a first refrigerant pipe connection port to be connected to one of the refrigerant pipes, the refrigerant pipes including a refrigerant pipe through which refrigerant flows from the heat source side unit into the heat medium heat exchanger and a refrigerant pipe through which the refrigerant flows out from the heat medium heat exchanger into the heat source side unit; a second refrigerant pipe connection port to be connected to an other of the refrigerant pipes; a first heat medium pipe connection port to be connected to one of the heat medium pipes, the heat medium pipes including a heat medium pipe through which a heat medium flows from the load side unit into the heat medium heat exchanger and a heat medium pipe through which the heat medium flows out from the heat medium heat exchanger into the load side unit; and a second heat medium pipe connection port to be connected to an other of the heat medium pipes. The first refrigerant pipe connection port, the second refrigerant pipe connection port, the first heat medium pipe connection port, and the second heat medium pipe connection port are provided on a top surface of the casing and face in a direction opposite to a direction of gravity.

An air-conditioning apparatus according to another embodiment of the present disclosure includes: a heat source side unit configured to generate a heat source; a load side unit configured to use the heat source generated by the heat source side unit; and the relay unit.

Advantageous Effects of Invention

According to the embodiments of the present disclosure, the port serving as a part to be connected to each of the refrigerant pipes and the heat medium pipes to be connected to the relay unit is provided on the top surface of the casing, and each port faces in the direction opposite to the direction of gravity. Thus, the refrigerant pipes and the heat medium pipes are connected, from above the casing, to the respective pipes connected to the heat medium heat exchanger. Accordingly, when the refrigerant pipes and the heat medium pipes extend in the upward direction from the top surface of the casing, it is possible to inhibit an increase in the pipe length compared with a configuration in which refrigerant pipes and heat medium pipes are attached to a side of a casing.

DESCRIPTION OF EMBODIMENTS

Embodiment 1

Figure 1:
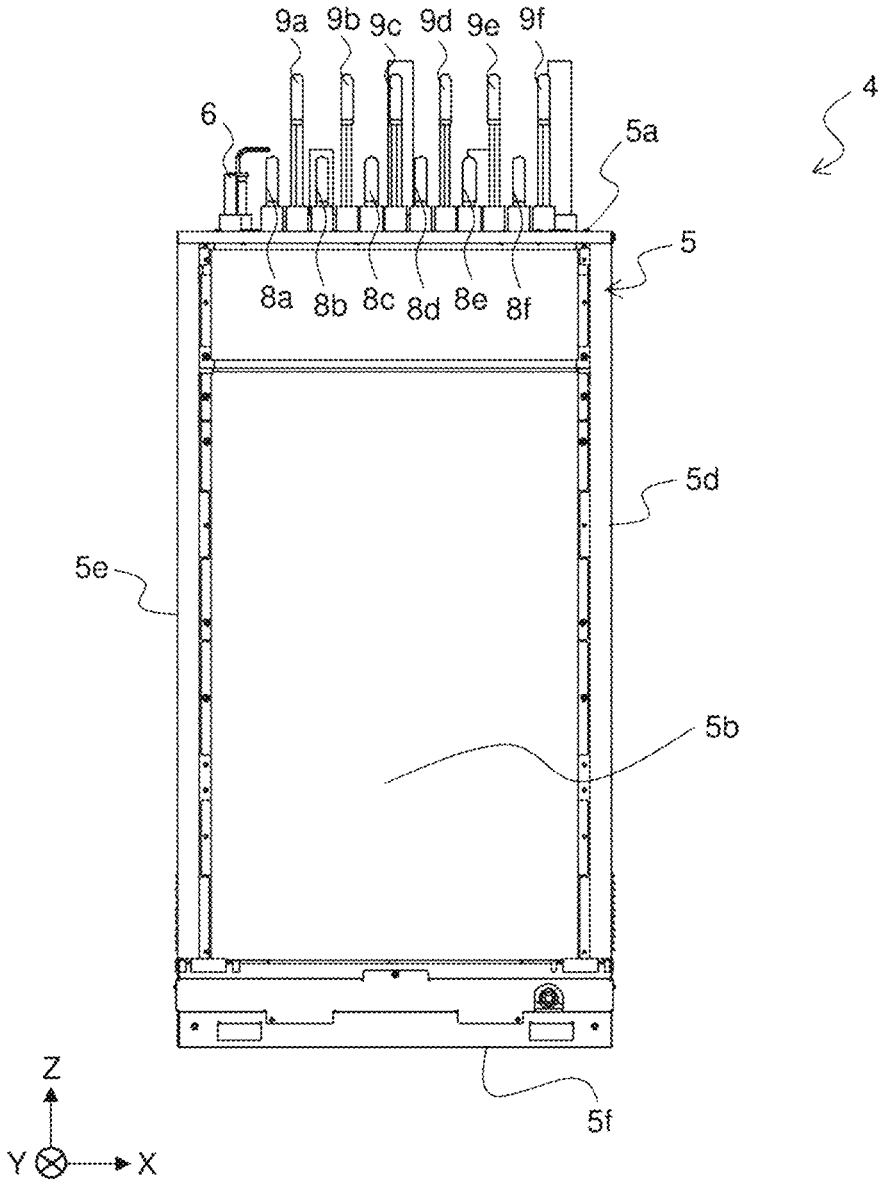
FIG. 1 is an external front view illustrating a configuration example of a relay unit according to Embodiment 1.
Figure 2:
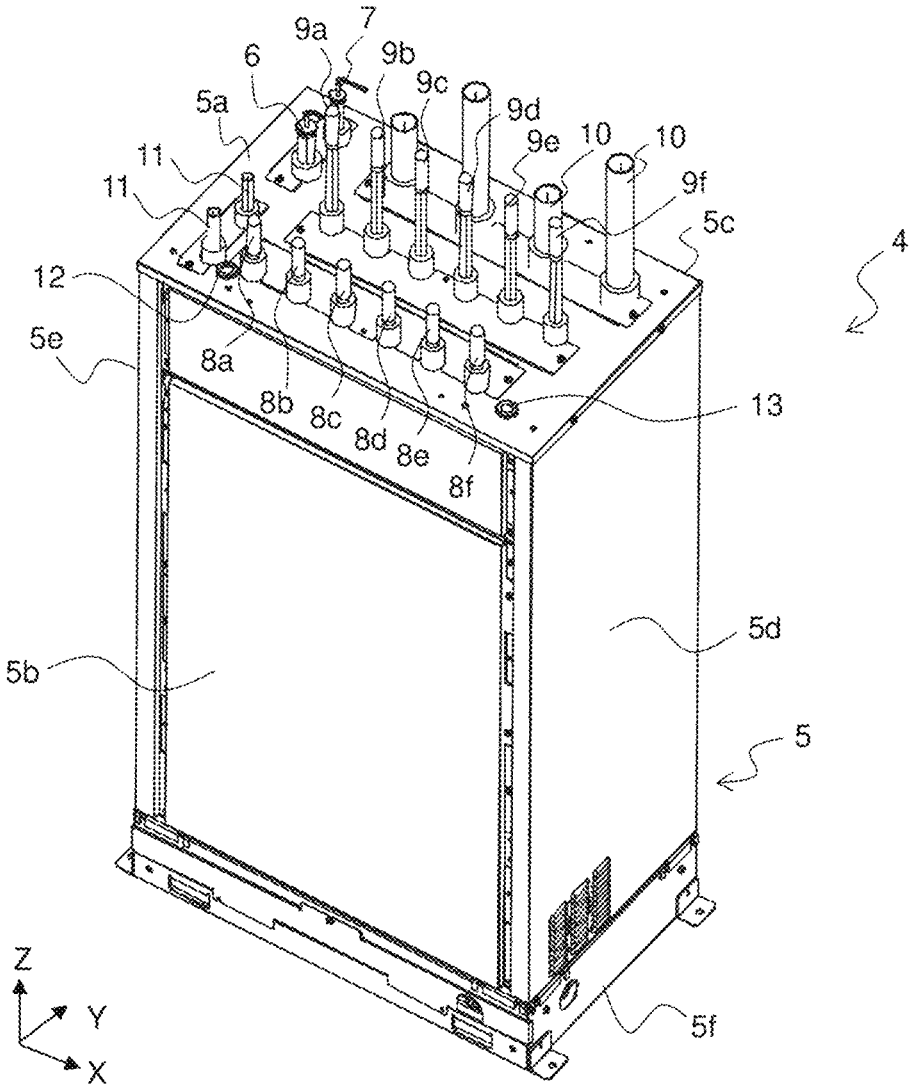
FIG. 2 is an external perspective view of the relay unit illustrated in FIG. 1.

The configuration of a relay unit in Embodiment 1 will be described. FIG. 1 is an external front view illustrating a configuration example of the relay unit according to Embodiment 1. FIG. 2 is an external perspective view of the relay unit illustrated in FIG. 1. As illustrated in FIGS. 1 and 2, a relay unit 4 includes a casing 5, which has a cuboid shape. The casing 5 has a top surface 5*a*, a first side 5*b*, a second side 5*c*, a third side 5*d*, a fourth side 5*e*, and a bottom surface 5*f*. The second side 5*c* faces the first side 5*b*. The fourth side 5*e* faces the third side 5*d*. In Embodiment 1, the first side 5*b* is a front panel of the relay unit 4, and the second side 5*c* is a rear panel of the relay unit 4. The first side 5*b*, which is a front panel, is configured to be detached from the casing 5 to enable an operator to perform maintenance of the relay unit 4.

As illustrated in FIGS. 1 and 2, a first refrigerant pipe connection port 6, a second refrigerant pipe connection port 7, first heat medium pipe connection ports 8*a* to 8*f*, and second heat medium pipe connection ports 9*a* to 9*f* are provided on the top surface 5*a* of the casing 5. The first refrigerant pipe connection port 6, the second refrigerant pipe connection port 7, the first heat medium pipe connection ports 8*a* to 8*f*, and the second heat medium pipe connection ports 9*a* to 9*f* each face in the direction opposite to the direction of gravity (direction of an arrow of the Z axis). In addition, refrigerant pipe connection ports 11, which serve as options, and heat medium pipe connection ports 10, which serve as options, are provided on the top surface 5*a* of the casing 5. The refrigerant pipe connection ports 11 and the heat medium pipe connection ports 10, which serve as options, each also face in the direction opposite to the direction of gravity.

The configuration illustrated in FIGS. 1 and 2 enables all refrigerant pipes and heat medium pipes to be each connected to extend in an upward direction (direction of the arrow of the Z axis) from the top surface 5*a* of the casing 5. Even when refrigerant pipes or heat medium pipes have to be connected as options, the refrigerant pipes and the heat medium pipes that are connected as options are each also connected to extend in the upward direction from the top surface 5*a* of the casing 5. Thus, it is possible to prevent pipes from extending in sideward directions of the casing 5 from any of the first side 5*b* to the fourth side 5*e*.

In addition, a first opening 12 for a power supply line and a second opening 13 for a transmission line are formed in the top surface 5*a*. A power supply line and a transmission line (not illustrated) are each also connected to extend from the top surface 5*a* of the casing 5. Thus, it is possible to prevent cables including a power supply line and a transmission line from extending in sideward directions of the casing 5 from any of the first side 5*b* to the fourth side 5*e*.

In addition, this configuration is a configuration in which pipes and cables extend upward from the top surface 5*a* of the casing 5. Thus, when an operator performs maintenance of the relay unit 4, the operator can easily perform operations by detaching the first side 5*b*.

As illustrated in FIGS. 1 and 2, the first heat medium pipe connection ports 8*a* to 8*f* are provided at respective positions in the top surface 5*a* closer to the first side 5*b*, and the second heat medium pipe connection ports 9*a* to 9*f* are provided at respective positions in the top surface 5*a* closer to the second side 5*c*. As illustrated in FIG. 1, the height of the first heat medium pipe connection ports 8*a* to 8*f* is lower than the height of the second heat medium pipe connection ports 9*a* to 9*f*. That is, the height of the first heat medium pipe connection ports 8*a* to 8*f* and the height of the second heat medium pipe connection ports 9*a* to 9*f* differ from each other.

Figure 3:
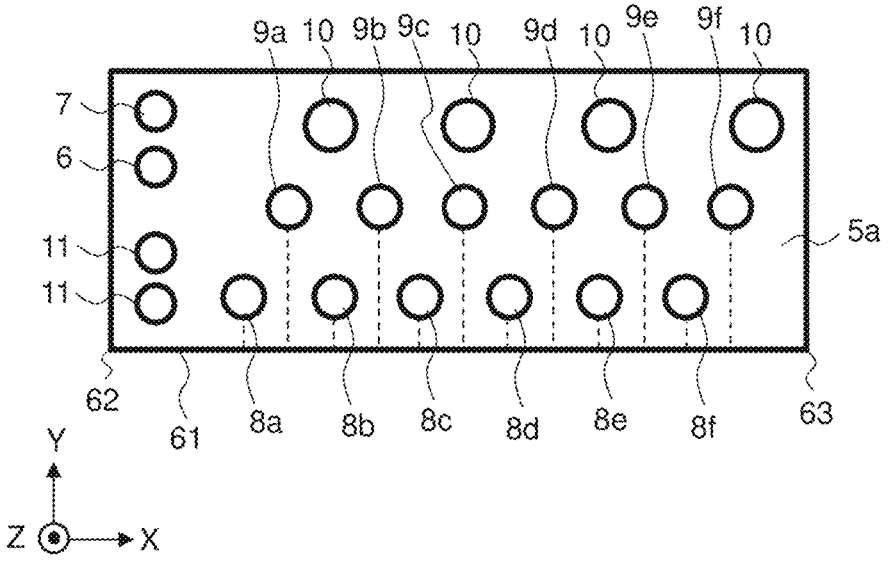
FIG. 3 is a schematic diagram illustrating the relay unit illustrated in FIG. 2 when viewed from above.

FIG. 3 is a schematic diagram illustrating the relay unit illustrated in FIG. 2 when viewed from above. For convenience of description, FIG. 3 does not illustrate the first opening 12 and the second opening 13, which are illustrated in FIG. 2. When referring to FIG. 3, the first heat medium pipe connection ports 8*a* to 8*f* are disposed to be spaced and to be parallel to a first edge 61, which is an edge where the top surface 5*a* and the first side 5*b* illustrated in FIG. 2 are in contact with each other. In addition, the second heat medium pipe connection ports 9*a* to 9*f* are disposed to be spaced and to be parallel to the first edge 61.

In FIG. 3, the positions of the first heat medium pipe connection ports 8*a* to 8*f* in the direction along the first edge 61 (direction of an arrow of the X axis) and the positions of the second heat medium pipe connection ports 9*a* to 9*f* in the direction along the first edge 61 are shifted from each other relative to one vertex 62, the vertex 62 and a vertex 63 being located at respective ends of the first edge 61. That is, the positions where the second heat medium pipe connection ports 9*a* to 9*f* are disposed are shifted, in the direction along the first edge 61, from the positions where the first heat medium pipe connection ports 8*a* to 8*f* are disposed.

Figure 4:
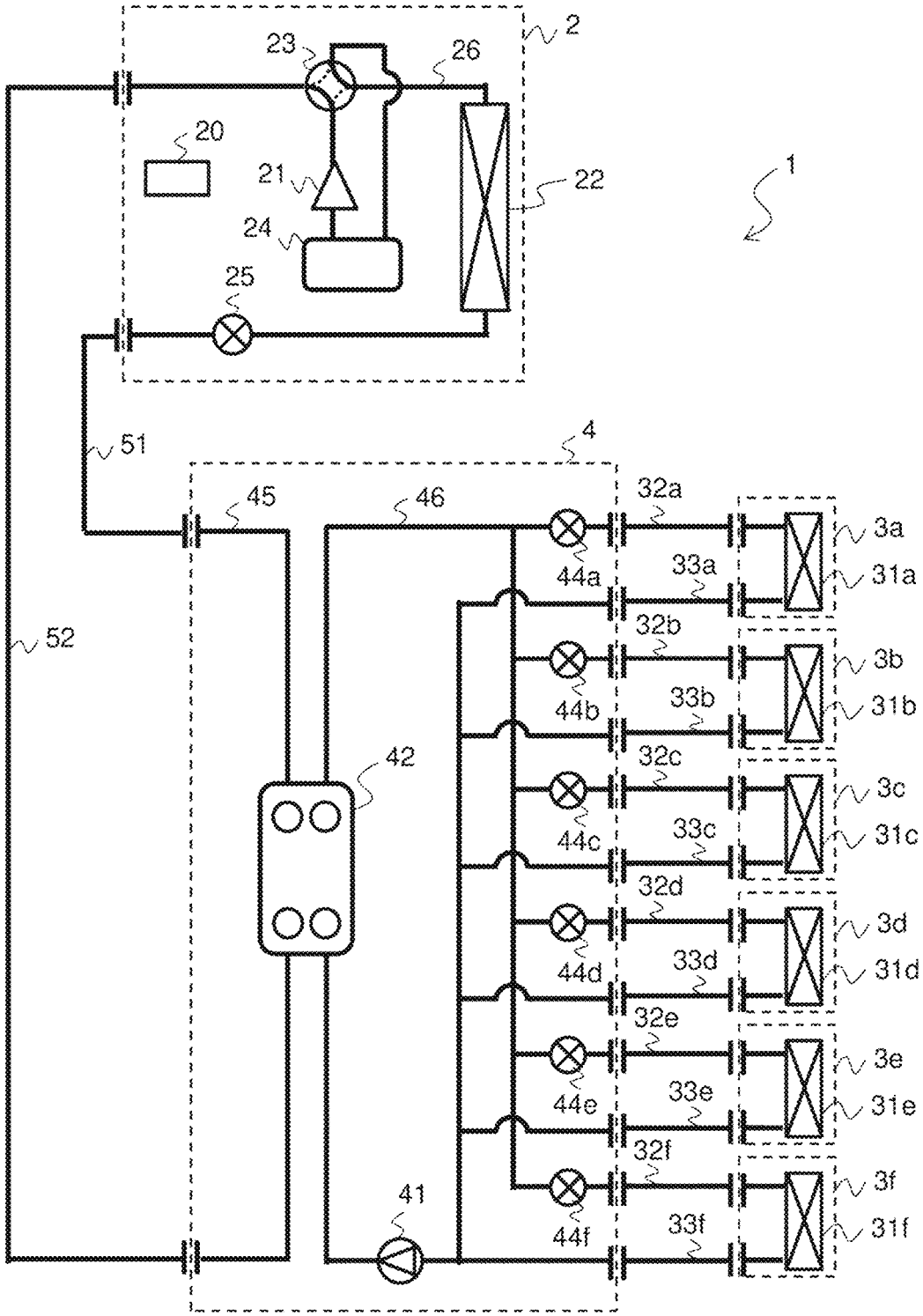
FIG. 4 is a circuit diagram illustrating a configuration example of an air-conditioning apparatus including the relay unit according to Embodiment 1.

Next, a configuration example of an air-conditioning apparatus including the relay unit 4 in Embodiment 1 will be described. FIG. 4 is a circuit diagram illustrating a configuration example of an air-conditioning apparatus including the relay unit according to Embodiment 1. As illustrated in FIG. 4, an air-conditioning apparatus 1 includes a heat source side unit 2, load side units 3*a* to 3*f*, and the relay unit 4, which is connected between the heat source side unit 2 and the load side units 3*a* to 3*f*.

The configuration example illustrated in FIG. 4 illustrates a case in which the air-conditioning apparatus 1 includes six load side units 3*a* to 3*f*. However, the number of load side units is not limited to six and may be one. Detailed descriptions of the configurations of the heat source side unit 2 and the load side units 3*a* to 3*f* are omitted in Embodiment 1. In addition, detailed descriptions of the refrigerant flow between the heat source side unit 2 and the relay unit 4 and the heat medium flow between the relay unit 4 and the load side units 3*a* to 3*f* are omitted in Embodiment 1.

The heat source side unit 2 and the relay unit 4 are connected by refrigerant pipes 51 and 52. Refrigerant circulates between the heat source side unit 2 and the relay unit 4 via the refrigerant pipes 51 and 52. The load side unit 3*a* and the relay unit 4 are connected by heat medium pipes 32*a* and 33*a*. A heat medium such as water or brine circulates between the load side unit 3*a* and the relay unit 4 via the heat medium pipes 32*a* and 33*a*. The load side unit 3*b* and the relay unit 4 are connected by heat medium pipes 32*b* and 33*b*. A heat medium circulates between the load side unit 3*b* and the relay unit 4 via the heat medium pipes 32*b* and 33*b*.

The load side unit 3*c* and the relay unit 4 are connected by heat medium pipes 32*c* and 33*c*. A heat medium circulates between the load side unit 3*c* and the relay unit 4 via the heat medium pipes 32*c* and 33*c*. The load side unit 3*d* and the relay unit 4 are connected by heat medium pipes 32*d* and 33*d*. A heat medium circulates between the load side unit 3*d* and the relay unit 4 via the heat medium pipes 32*d* and 33*d*. The load side unit 3*e* and the relay unit 4 are connected by heat medium pipes 32*e* and 33*e*. A heat medium circulates between the load side unit 3*e* and the relay unit 4 via the heat medium pipes 32*e* and 33*e*. The load side unit 3*f* and the relay unit 4 are connected by heat medium pipes 32*f* and 33*f*. A heat medium circulates between the load side unit 3*f* and the relay unit 4 via the heat medium pipes 32*f* and 33*f*.

The heat source side unit 2 includes a compressor 21, a heat source side heat exchanger 22, a four-way valve 23, an accumulator 24, an expansion valve 25, and a controller 20, which is configured to control the air-conditioning apparatus 1. The compressor 21, the heat source side heat exchanger 22, the four-way valve 23, the accumulator 24, and the expansion valve 25 are connected via refrigerant pipes 26.

The load side unit 3*a* includes a load side heat exchanger 31*a*. The load side unit 3*b* includes a load side heat exchanger 31*b*. The load side unit 3*c* includes a load side heat exchanger 31*c*. The load side unit 3*d* includes a load side heat exchanger 31*d*. The load side unit 3*e* includes a load side heat exchanger 31*e*. The load side unit 3*f* includes a load side heat exchanger 31*f*.

The relay unit 4 includes a pump 41, a heat medium heat exchanger 42, and flow control valves 44*a* to 44*f*. The heat medium heat exchanger 42, the pump 41, and the flow control valves 44*a* to 44*f* are connected via heat medium pipes 46. One of two refrigerant pipe connection ports of the heat medium heat exchanger 42 is connected to the expansion valve 25 of the heat source side unit 2 via refrigerant pipes 45 and 51. The other of the two refrigerant pipe connection ports of the heat medium heat exchanger 42 is connected to the four-way valve 23 of the heat source side unit 2 via refrigerant pipes 45 and 52.

One of two heat medium pipe connection ports of the heat medium heat exchanger 42 is connected to the flow control valves 44*a* to 44*f* via the heat medium pipes 46 forming six branches. The other of the two heat medium pipe connection ports of the heat medium heat exchanger 42 is connected to a heat medium discharge port of the pump 41 via heat medium pipes 46. The flow control valve 44*a* is connected to the load side heat exchanger 31*a* via the heat medium pipe 32*a*. The flow control valve 44*b* is connected to the load side heat exchanger 31*b* via the heat medium pipe 32*b*. The flow control valve 44*c* is connected to the load side heat exchanger 31*c* via the heat medium pipe 32*c*, The flow control valve 44*d* is connected to the load side heat exchanger 31*d* via the heat medium pipe 32*d*. The flow control valve 44*e* is connected to the load side heat exchanger 31*e* via the heat medium pipe 32*e*. The flow control valve 44*f* is connected to the load side heat exchanger 31*f* via the heat medium pipe 32*f*. The heat medium pipes 46 located closer to a heat medium suction port of the pump 41 form six branches and are connected to the heat medium pipes 33*a* to 33*f*.

Next, the pipe connection configuration between the relay unit 4 illustrated in FIG. 2 and each of the heat source side unit 2 and the load side units 3*a* to 3*f* illustrated in FIG. 4 will be described.

One of the refrigerant pipes 51 and 52 illustrated in FIG. 4 is connected to the first refrigerant pipe connection port 6 illustrated in FIG. 2. The other of the refrigerant pipes 51 and 52 illustrated in FIG. 4 is connected to the second refrigerant pipe connection port 7. The first heat medium pipe connection port 8*a* illustrated in FIG. 2 is connected to one of the heat medium pipes 32*a* and 33*a* illustrated in FIG. 4. The second heat medium pipe connection port 9*a* illustrated in FIG. 2 is connected to the other of the heat medium pipes 32*a* and 33*a* illustrated in FIG. 4. The first heat medium pipe connection port 8*b* illustrated in FIG. 2 is connected to one of the heat medium pipes 32*b* and 33*b* illustrated in FIG. 4. The second heat medium pipe connection port 9*b* illustrated in FIG. 2 is connected to the other of the heat medium pipes 32*b* and 33*b* illustrated in FIG. 4.

The first heat medium pipe connection port 8*c* illustrated in FIG. 2 is connected to one of the heat medium pipes 32*c* and 33*c* illustrated in FIG. 4. The second heat medium pipe connection port 9*c* illustrated in FIG. 2 is connected to the other of the heat medium pipes 32*c* and 33*c* illustrated in FIG. 4. The first heat medium pipe connection port 8*d* illustrated in FIG. 2 is connected to one of the heat medium pipes 32*d* and 33*d* illustrated in FIG. 4. The second heat medium pipe connection port 9*d* illustrated in FIG. 2 is connected to the other of the heat medium pipes 32*d* and 33*d* illustrated in FIG. 4. The first heat medium pipe connection port 8*e* illustrated in FIG. 2 is connected to one of the heat medium pipes 32*e* and 33*e* illustrated in FIG. 4. The second heat medium pipe connection port 9*e* illustrated in FIG. 2 is connected to the other of the heat medium pipes 32*e* and 33*e* illustrated in FIG. 4. The first heat medium pipe connection port 8*f* illustrated in FIG. 2 is connected to one of the heat medium pipes 32*f* and 33*f* illustrated in FIG. 4. The second heat medium pipe connection port 9*f* illustrated in FIG. 2 is connected to the other of the heat medium pipes 32*f* and 33*f* illustrated in FIG. 4.

The ports for connecting the respective refrigerant pipes and the ports for connecting the respective heat medium pipes are not gathered on any of the first side 5*b* to the fourth side 5*e* of the casing 5 but on the top surface 5*a*. In addition, as illustrated in FIG. 3, similarly to the arrangement of the first heat medium pipe connection port 8*a* and the second heat medium pipe connection port 9*a*, the heat medium pipes are arranged, in the direction of the arrow of the X axis from the vertex 62, alternately at the positions in the top surface 5*a* closer to the first side 5*b* and the positions in the top surface 5*a* closer to the second side 5*c*. The spaces between the connection ports adjacent to each other are wide. Thus, when an operator connects the heat medium pipes to the relay unit 4, the operator can easily perform pipe connection operations. Furthermore, the height of the first heat medium pipe connection ports 8*a* to 8*f* and the height of the second heat medium pipe connection ports 9*a* to 9*f* differ from each other, thus improving the ease of connecting the heat medium pipes to the relay unit 4.

Next, a trial operation of the installed air-conditioning apparatus 1 in Embodiment 1 will be described. An operator installs the air-conditioning apparatus 1 illustrated in FIG. 4 and then fills a heat medium into the heat medium pipes 32*a* to 32*f*, 33*a* to 33*f*, and 46. Subsequently, the operator has to purge air from the heat medium pipes 32*a* to 32*f*, 33*a* to 33*f*, and 46. Air remaining in a heat medium can result in malfunction of the pump 41 in addition to impairment of heat exchange efficiency.

Figure 5:
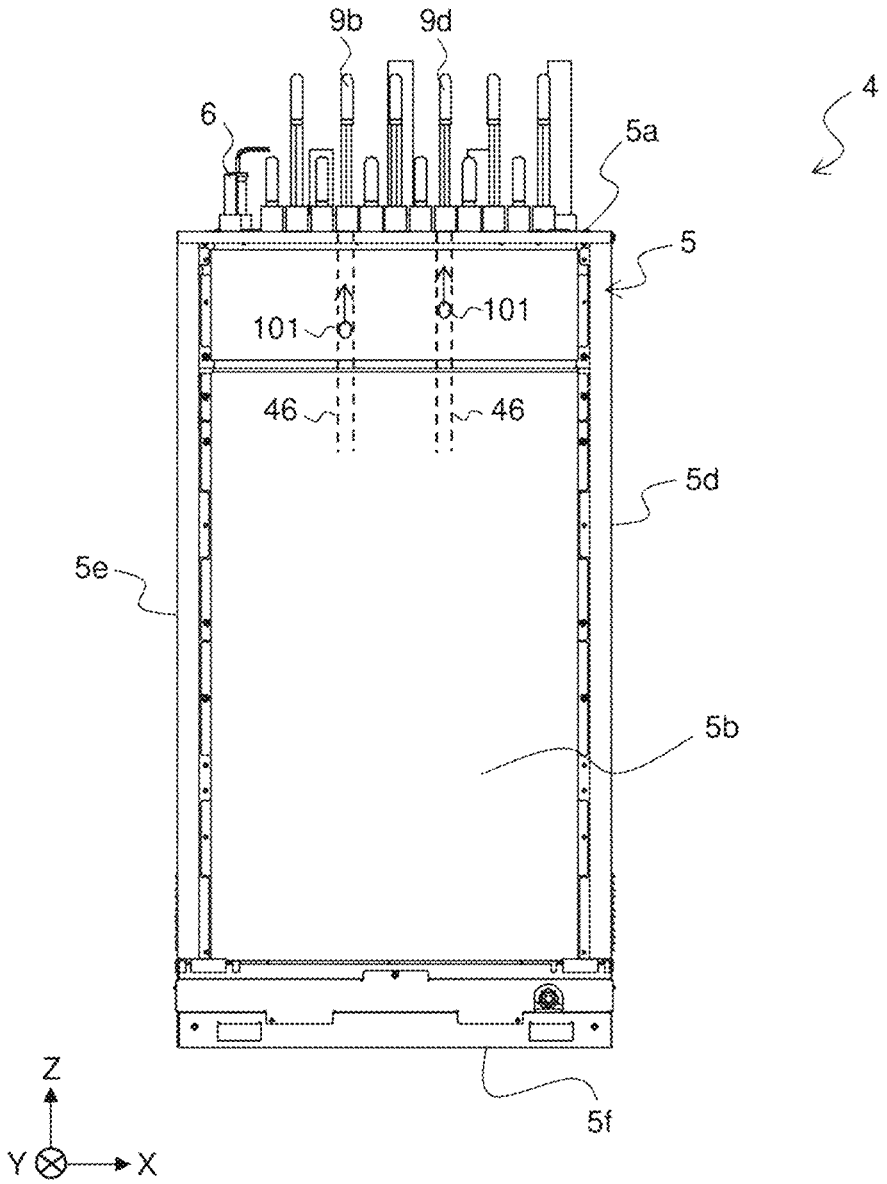
FIG. 5 is an external front view schematically illustrating the state of the inside of each heat medium pipe of the relay unit illustrated in FIG. 1.

In the relay unit 4 in Embodiment 1, air is easily purged from a heat medium filled in the heat medium pipes 46 compared with a horizontal pipe structure in which heat medium pipes are attached to a side of a casing in a sideward direction. This will be described with reference to FIG. 5. FIG. 5 is an external front view schematically illustrating the state of the inside of each heat medium pipe of the relay unit illustrated in FIG. 1. FIG. 5 schematically illustrates the heat medium pipe 46 connected to each of the second heat medium pipe connection ports 9*b* and 9*d*.

For example, when the heat medium is water and water is filled in the heat medium pipes 46 of the relay unit 4, as illustrated in FIG. 5, air 101 moves in the heat medium pipes 46 in the direction opposite to the direction of gravity (direction of the arrow of the Z axis) because the air 101 has a density lower than that of water. It is clear that provision of an air purge valve above each of the second heat medium pipe connection ports 9*b* and 9*d* enables the air 101 to be easily purged from the heat medium pipe 46.

The first refrigerant pipe connection port 6, the second refrigerant pipe connection port 7, the first heat medium pipe connection ports 8*a* to 8*f*, and the second heat medium pipe connection ports 9*a* to 9*f* are provided on the top surface 5*a* of the casing 5 of the relay unit 4 in Embodiment 1. The first refrigerant pipe connection port 6, the second refrigerant pipe connection port 7, the first heat medium pipe connection ports 8*a* to 8*f*, and the second heat medium pipe connection ports 9*a* to 9*f* each face in the direction opposite to the direction of gravity.

According to Embodiment 1, the port serving as a part to be connected to each of the refrigerant pipes and the heat medium pipes to be connected to the relay unit 4 is provided on the top surface 5*a* of the casing 5, and each port faces in the direction opposite to the direction of gravity. Thus, the refrigerant pipes and the heat medium pipes are connected, from above the casing 5, to the respective pipes connected to the heat medium heat exchanger 42. When the refrigerant pipes and the heat medium pipes extend in the upward direction from the top surface 5*a* of the casing 5, it is possible to inhibit an increase in the pipe length compared with an existing relay unit in which refrigerant pipes and heat medium pipes are attached to a side of a casing.

In addition, in the relay unit 4 in Embodiment 1, pipes such as a refrigerant pipe and cables such as a power supply line are not connected to the first side 5*b*, which is the front side of the casing 5. Accordingly, an operator can use the front side of the casing 5 as a maintenance space for the relay unit 4 and easily detach the first side 5*b*, thus improving maintenance efficiency.

Furthermore, the first heat medium pipe connection ports 8*a* to 8*f* and the second heat medium pipe connection ports 9*a* to 9*f* are provided on the top surface 5*a* of the casing 5 of the relay unit 4 in Embodiment 1, and each port faces in the direction opposite to the direction of gravity. Thus, as described with reference to FIG. 5, when the air 101 is purged from a heat medium filled in heat medium pipes such as the heat medium pipes 46, the air 101 easily moves in the upward direction of the casing 5. As a result, since air is easily purged from the heat medium pipes compared with a horizontal pipe structure, an operator can purge air in a short time.

Embodiment 2

Embodiment 2 is an example in which heat medium pipes are connected to the relay unit 4 described in Embodiment 1. In Embodiment 2, the same components as those described in Embodiment 1 have the same reference signs, and detailed descriptions thereof are omitted.

Figure 6:
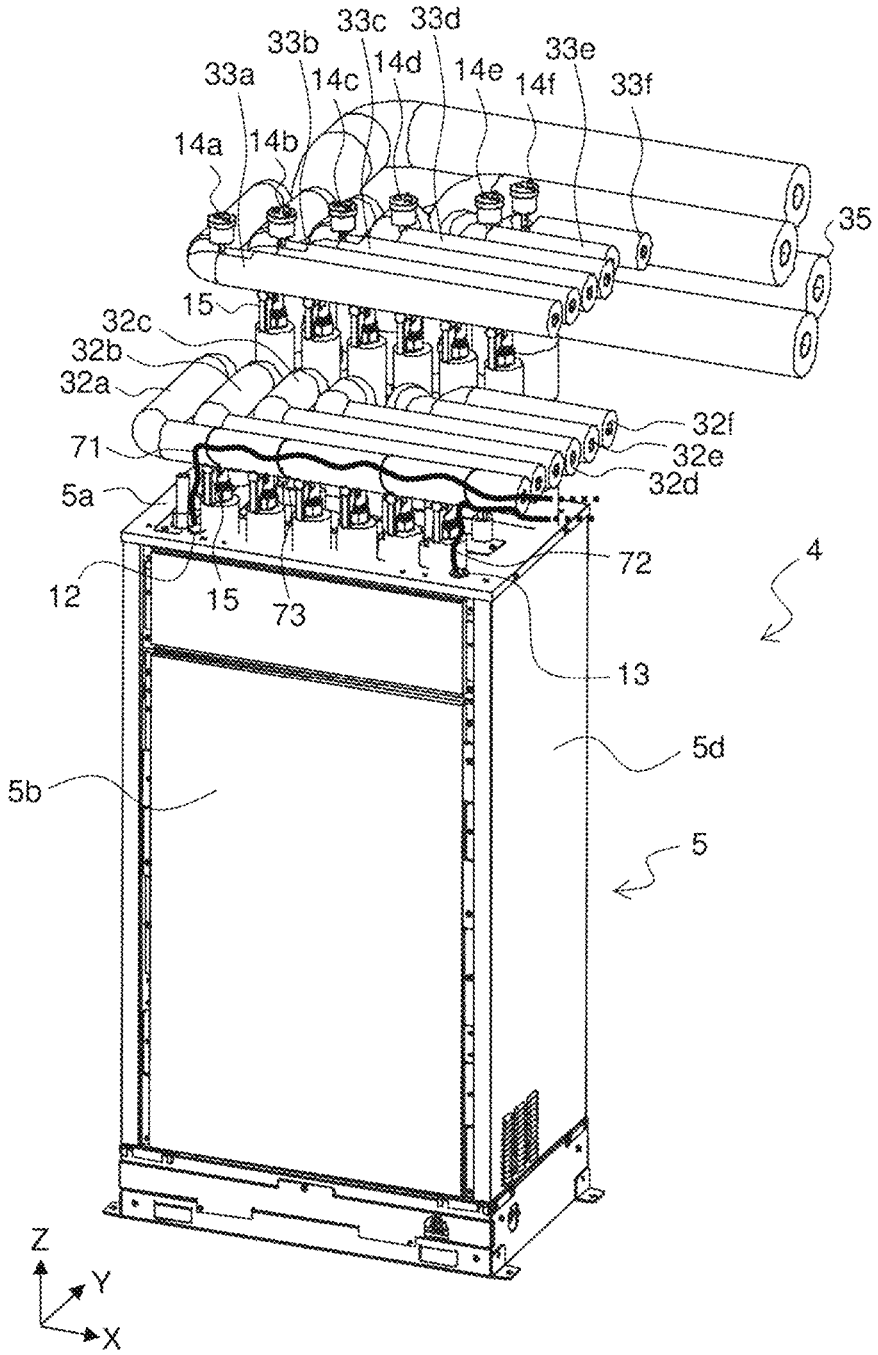
FIG. 6 is an external perspective view illustrating a configuration example of a relay unit according to Embodiment 2 to which pipes are connected.

The configuration of the relay unit 4 in Embodiment 2 will be described. FIG. 6 is an external perspective view illustrating a configuration example of a relay unit according to Embodiment 2 to which pipes are connected. In the configuration example illustrated in FIG. 6, the heat medium pipe 32*a* illustrated in FIG. 4 is connected to the first heat medium pipe connection port 8*a* illustrated in FIG. 2. The heat medium pipe 32*b* illustrated in FIG. 4 is connected to the first heat medium pipe connection port 8*b* illustrated in FIG. 2. The heat medium pipe 32*c* illustrated in FIG. 4 is connected to the first heat medium pipe connection port 8*c* illustrated in FIG. 2. The heat medium pipe 32*d* illustrated in FIG. 4 is connected to the first heat medium pipe connection port 8*d* illustrated in FIG. 2. The heat medium pipe 32*e* illustrated in FIG. 4 is connected to the first heat medium pipe connection port 8*e* illustrated in FIG. 2. The heat medium pipe 32*f* illustrated in FIG. 4 is connected to the first heat medium pipe connection port 8*f* illustrated in FIG. 2.

In the configuration example illustrated in FIG. 6, the heat medium pipes 32*a* to 32*f* and 33*a* to 33*f* extend in the direction of the arrow of the X axis. However, the direction in which pipes are disposed is not limited to that illustrated in FIG. 6. In addition, FIG. 6 illustrates an example in which heat medium pipes 35 are connected to the respective heat medium pipe connection ports 10 illustrated in FIG. 2. However, when the heat medium pipe connection ports 10 are not used, the heat medium pipes 35 do not have to be provided.

In the configuration example illustrated in FIG. 6, the heat medium pipe 33*a* illustrated in FIG. 4 is connected to the second heat medium pipe connection port 9*a* illustrated in FIG. 2. The heat medium pipe 33*b* illustrated in FIG. 4 is connected to the second heat medium pipe connection port 9*b* illustrated in FIG. 2. The heat medium pipe 33*c* illustrated in FIG. 4 is connected to the second heat medium pipe connection port 9*c* illustrated in FIG. 2. The heat medium pipe 33*d* illustrated in FIG. 4 is connected to the second heat medium pipe connection port 9*d* illustrated in FIG. 2. The heat medium pipe 33*e* illustrated in FIG. 4 is connected to the second heat medium pipe connection port 9*e* illustrated in FIG. 2. The heat medium pipe 33*f* illustrated in FIG. 4 is connected to the second heat medium pipe connection port 9*f* illustrated in FIG. 2.

An air purge valve 14*a* is provided at a place in the heat medium pipe 33*a* located above the second heat medium pipe connection port 9*a* illustrated in FIG. 2. An air purge valve 14*b* is provided at a place in the heat medium pipe 33*b* located above the second heat medium pipe connection port 9*b* illustrated in FIG. 2. An air purge valve 14*c* is provided at a place in the heat medium pipe 33*c* located above the second heat medium pipe connection port 9*c* illustrated in FIG. 2.

An air purge valve 14*d* is provided at a place in the heat medium pipe 33*d* located above the second heat medium pipe connection port 9*d* illustrated in FIG. 2. An air purge valve 14*e* is provided at a place in the heat medium pipe 33*e* located above the second heat medium pipe connection port 9*e* illustrated in FIG. 2. An air purge valve 14*f* is provided at a place in the heat medium pipe 33*f* located above the second heat medium pipe connection port 9*f* illustrated in FIG. 2.

In the configuration example illustrated in FIG. 6, an on-off valve 15 is provided at each of the first heat medium pipe connection ports 8*a* to 8*f* and the second heat medium pipe connection ports 9*a* to 9*f* illustrated in FIG. 2. As described in Embodiment 1 with reference to FIG. 1, the height of the first heat medium pipe connection ports 8*a* to 8*f* and the height of the second heat medium pipe connection ports 9*a* to 9*f* differ from each other. The second heat medium pipe connection ports 9*a* to 9*f* are higher than the first heat medium pipe connection ports 8*a* to 8*f*, and the levels thereof thus differ from each other. Accordingly, space is formed between the heat medium pipes 32*a* to 32*f* and the heat medium pipes 33*a* to 33*f*, facilitating operation of the on-off valve 15 of each of the second heat medium pipe connection ports 9*a* to 9*f*.

Although not illustrated in FIG. 6, an air purge valve may be provided at each of the heat medium pipes 32*a* to 32*f*. The heat medium pipes 33*a* to 33*f* are located higher than the heat medium pipes 32*a* to 32*f*. Thus, even when air purge valves (not illustrated) are provided on the respective heat medium pipes 32*a* to 32*f*, the air purge valves do not interfere with the heat medium pipes 33*a* to 33*f*.

As described in Embodiment 1, the first opening 12 and the second opening 13 are formed in the top surface 5*a* of the casing 5. As illustrated in FIG. 6, a power supply line 71 extends from the first opening 12 and is connected to a power supply (not illustrated). A transmission line 72 extends from the second opening 13 and is connected to the controller 20 illustrated in FIG. 4. The transmission line 72 serves to transmit a control signal output from the controller 20. The power supply line 71 and the transmission line 72 are disposed along the heat medium pipe 32*a* and are fastened to the heat medium pipe 32*a* with a cable tie 73. In the casing 5, the power supply line 71 is connected to the pump 41 and the flow control valves 44*a* to 44*f* illustrated in FIG. 4. In the casing 5, the transmission line 72 is connected to the pump 41 and the flow control valves 44*a* to 44*f* illustrated in FIG. 4.

In the relay unit 4 in Embodiment 2, the first heat medium pipe connection ports 8*a* to 8*f* are provided at the respective positions closer to the first side 5*b*, and the second heat medium pipe connection ports 9*a* to 9*f* are provided at the respective positions closer to the second side 5*c*. The height of the first heat medium pipe connection ports 8*a* to 8*f* is lower than the height of the second heat medium pipe connection ports 9*a* to 9*f*. Since the height of the second heat medium pipe connection ports 9*a* to 9*f* located closer to the rear side of the casing 5 is higher than the height of the first heat medium pipe connection ports 8*a* to 8*f* located closer to the front side of the casing 5, an operator can easily operate the on-off valve 15 attached to each of the second heat medium pipe connection ports 9*a* to 9*f* and easily attach the air purge valves 14*a* to 14*f* above the second heat medium pipe connection ports 9*a* to 9*f*. In this manner, Embodiment 2 facilitates attachment of air purge valves, and hangers necessary for a horizontal pipe structure do not have to be provided, thus improving workability and serviceability.

In addition, in Embodiment 2, the relay unit 4 may include the power supply line 71 extending from the inside of the casing 5 via the first opening 12 formed in the top surface 5*a* of the casing 5. Furthermore, the relay unit 4 may include the transmission line 72 extending from the inside of the casing 5 via the second opening 13 formed in the top surface 5*a* of the casing 5.

Since the first opening 12 and the second opening 13 are formed in the top surface 5*a* of the casing 5, it is possible to draw out, through the top surface 5*a* of the casing 5, the power supply line 71 and the transmission line 72 connected to the inside of the relay unit 4. Thus, it is possible to route the power supply line 71 and the transmission line 72 along pipes such as the heat medium pipe 32*a* extending toward a ceiling.

Embodiment 2 enables pipes such as refrigerant pipes and heat medium pipes and cables including the power supply line 71 and the transmission line 72 to be bundled together and to be fixed to the top surface 5*a* of the casing 5. Thus, such cables are not attached to the front side. Accordingly, when an operator detaches the front panel to perform maintenance of the relay unit 4, the operator does not have to beware of cutting cables compared with an example in which cables are attached to the front of a casing. In addition, since cables are not attached to the front side of the casing 5, the operator can use the front side of the casing 5 as a maintenance space, thus improving maintenance efficiency.

Embodiment 3

Embodiment 3 is an example in which the relay unit 4 described in Embodiment 1 includes a drain pan. In Embodiment 3, the same components as those described in Embodiments 1 and 2 have the same reference signs, and detailed descriptions thereof are omitted.

Figure 7:
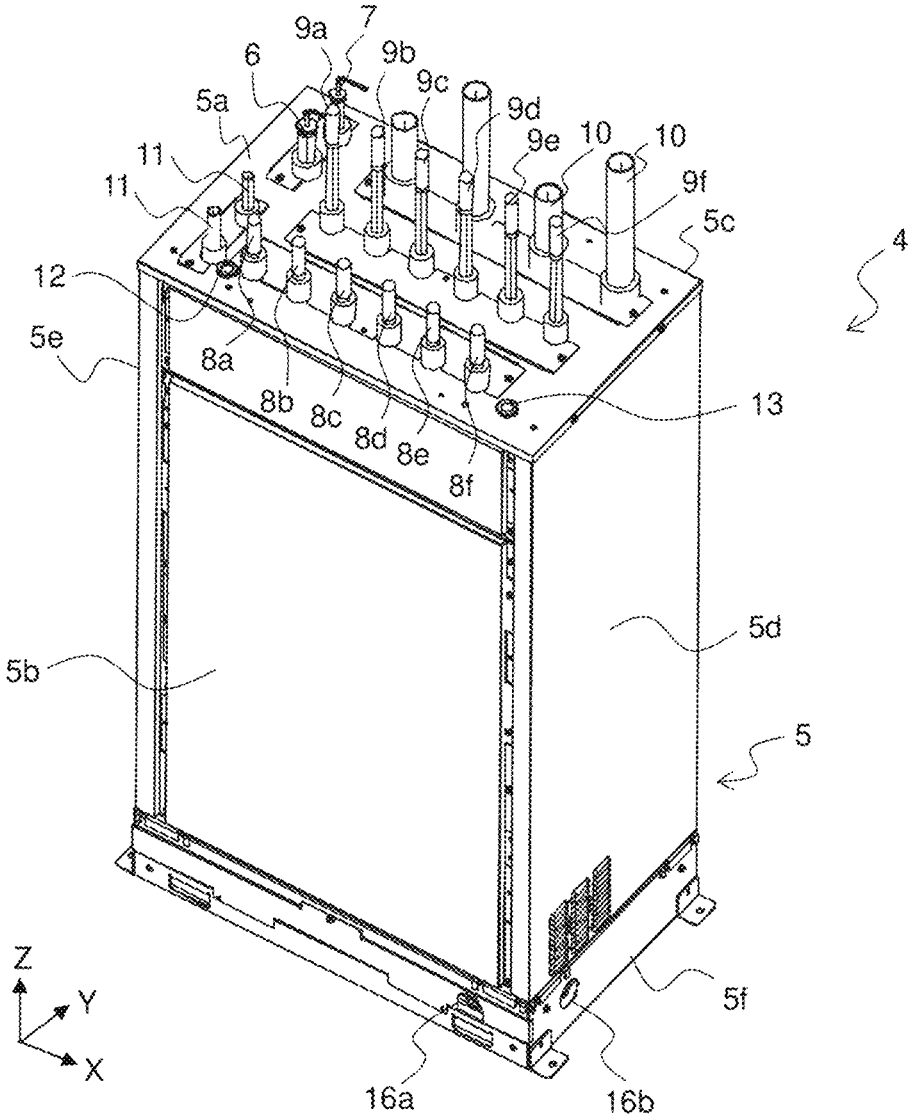
FIG. 7 is an external perspective view illustrating a configuration example of a relay unit according to Embodiment 3.
Figure 8:
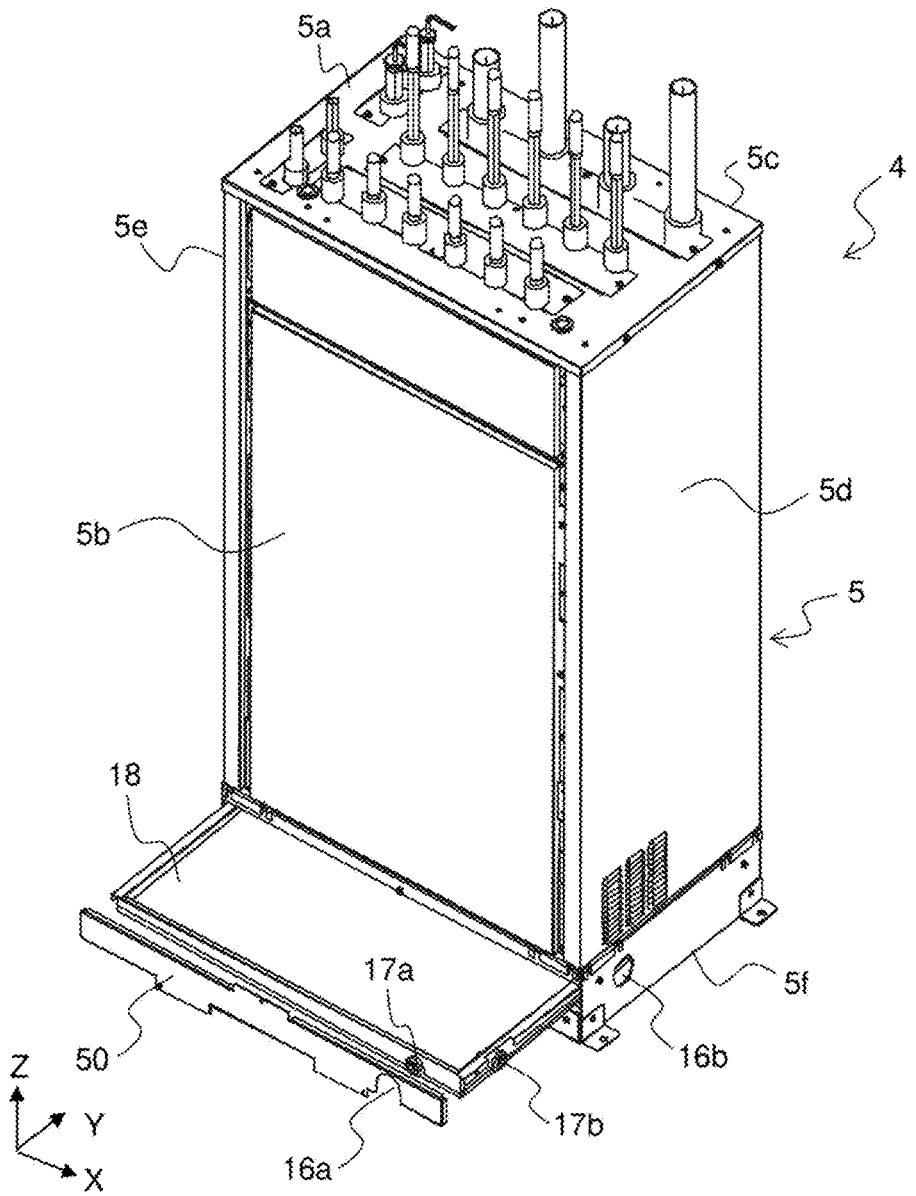
FIG. 8 is an external perspective view illustrating the relay unit illustrated in FIG. 7 whose drain pan is drawn out.

The configuration of the relay unit 4 in Embodiment 3 will be described. FIG. 7 is an external perspective view illustrating a configuration example of a relay unit according to Embodiment 3. FIG. 8 is an external perspective view illustrating the relay unit illustrated in FIG. 7 whose drain pan is drawn out.

As illustrated in FIG. 8, the relay unit 4 includes a drain pan 18. FIG. 8 illustrates a state in which the drain pan 18 is drawn out from the casing 5. FIG. 7 illustrates a state in which the drain pan 18 is housed in the casing 5. In FIG. 7, the drain pan 18 illustrated in FIG. 8 is disposed above the bottom surface 5*f*. The drain pan 18 serves to store dew condensation water generated when condensation occurs on a surface of the heat medium heat exchanger 42 illustrated in FIG. 4.

As illustrated in FIG. 8, the drain pan 18 includes a first drain port 17*a* and a second drain port 17*b*. In the state in which the drain pan 18 is housed in the casing 5, a first drain socket 16*a* is formed in the part of the first side 5*b* located at the position equivalent to the first drain port 17*a*, and a second drain socket 16*b* is formed in the part of the third side 5*d* located at the position equivalent to the second drain port 17*b*. In Embodiment 3, as illustrated in FIG. 8, the first side 5*b* includes a drawer panel 50, which is a part configured to be separate. An operator can slide the drain pan 18 and draw out the drain pan 18 from the casing 5 by drawing the drawer panel 50 in the direction opposite to the direction of an arrow of the Y axis. An operator can slide the drain pan 18 and house the drain pan 18 in the casing 5 by pushing the drawer panel 50 in the direction of the arrow of the Y axis.

Figure 9:
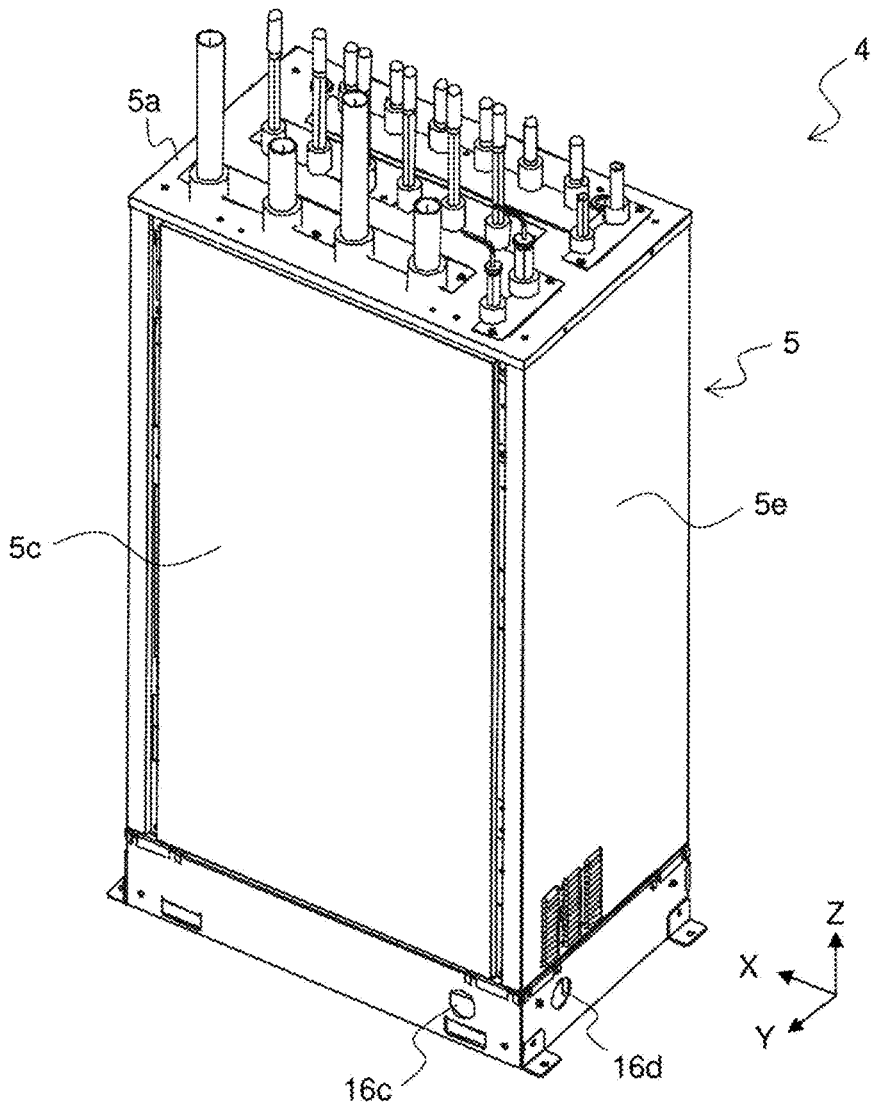
FIG. 9 is an external perspective view of the relay unit illustrated in FIG. 7 when viewed in a different direction.

FIG. 9 is an external perspective view of the relay unit illustrated in FIG. 7 when viewed in a different direction. As illustrated in FIG. 9, a third drain socket 16*c* is formed in the part of the second side 5*c* located at the position equivalent to the height of the drain pan 18 housed in the casing 5, and a fourth drain socket 16*d* is formed in the part of the fourth side 5*e* located at the position equivalent to the height of the drain pan 18 housed in the casing 5.

Figure 10:
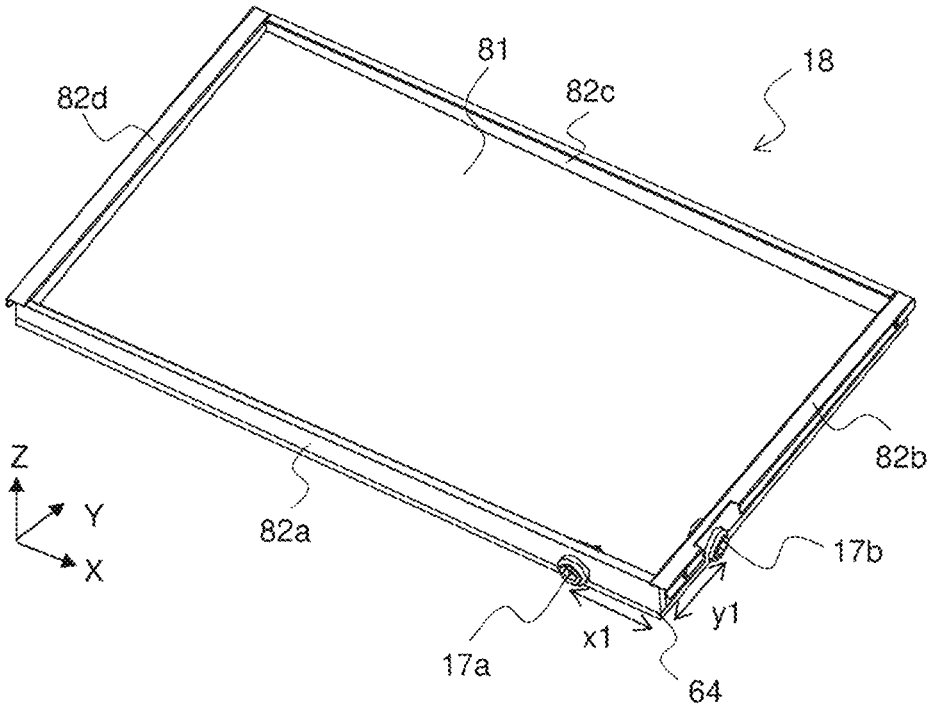
FIG. 10 is an external perspective view illustrating a configuration example of the drain pan illustrated in FIG. 8.

Next, the overall configuration of the drain pan 18 illustrated in FIG. 8 will be described. FIG. 10 is an external perspective view illustrating a configuration example of the drain pan illustrated in FIG. 8. The drain pan 18 includes a plate 81, which has a rectangular shape corresponding to the shape of the bottom surface 5*f*, and four frame portions 82*a* to 82*d*, which are provided around the plate 81. The four frame portions 82*a* to 82*d* prevent dew condensation water from leaking out from the plate 81. Of the two frame portions 82*a* and 82*b* adjacent to each other, the first drain port 17*a* is formed at the position in one frame portion, that is, the frame portion 82*a*, at a first distance x1 from a second edge 64, where the two frame portions 82*a* and 82*b* are in contact with each other, and the second drain port 17*b* is formed at the position in the other frame portion, that is, the frame portion 82*b*, at a second distance y1 from the second edge 64. FIG. 9 illustrates an example in which the drain pan 18 is inserted into the casing 5 such that the frame portion 82*c* is located closer to the second side 5*c* of the casing 5 illustrated in FIG. 8.

Figure 11:
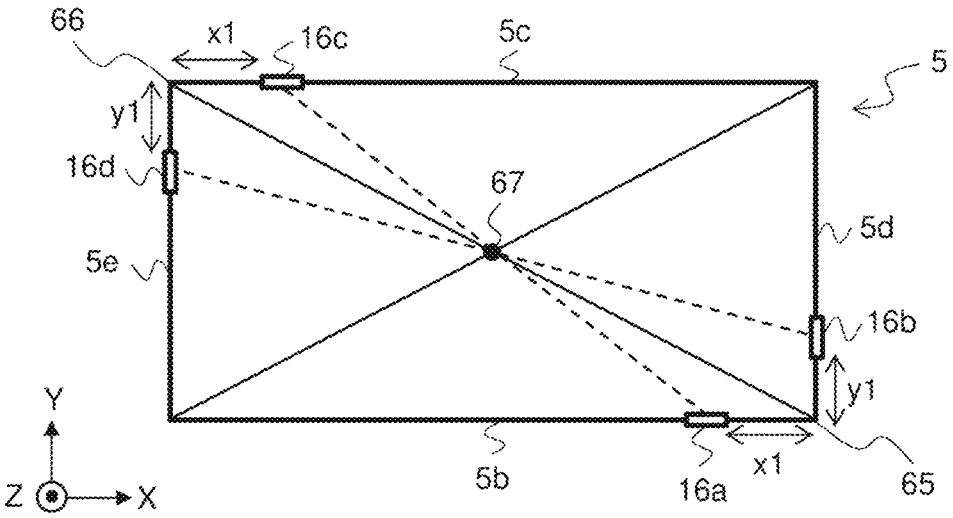
FIG. 11 is a schematic diagram illustrating a horizontal section of the relay unit illustrated in FIG. 7 taken at the position at the height of the drain pan.

Next, the positional relationships between the first drain socket 16*a* to the fourth drain socket 16*d* illustrated in FIGS. 8 and 9 will be described. FIG. 11 is a schematic diagram illustrating a horizontal section of the relay unit illustrated in FIG. 7 taken at the position at the height of the drain pan.

In FIG. 11, an edge where the first side 5*b* and the third side 5*d* are in contact with each other is a third edge 65, and an edge where the second side 5*c* and the fourth side 5*e* are in contact with each other is a fourth edge 66. The rectangular shape illustrated in FIG. 11 corresponds to the shape of the bottom surface 5*f*. A centroid 67 of the rectangular shape illustrated in FIG. 11 overlaps the centroid of the bottom surface 5*f* on the Z axis. As illustrated in FIG. 11 the first drain socket 16*a* is formed at the position in the first side 5*b* at the first distance x1 from the third edge 65, and the second drain socket 16*b* is formed at the position in the third side 5*d* at the second distance y1 from the third edge 65.

In addition, the third drain socket 16*c* is formed at a position in the second side 5*c*, the position in the second side 5*c* and the position of the first drain socket 16*a* being symmetrical relative to the centroid 67 as the symmetry center point. That is, the third drain socket 16*c* is formed at the position in the second side 5*c* at the first distance x1 from the fourth edge 66. The fourth drain socket 16*d* is formed at a position in the fourth side 5*e*, the position in the fourth side 5*e* and the position of the second drain socket 16*b* being symmetrical relative to the centroid 67 as the symmetry center point. The fourth drain socket 16*d* is formed at the position in the fourth side 5*e* at the second distance y1 from the fourth edge 66.

The configuration illustrated in FIG. 11 enables the drain pan 18 to be inserted into the casing 5 such that the frame portion 82*c* is located closer to the second side 5*c* of the casing 5 and such that the frame portion 82*a* is located closer to the second side 5*c* of the casing 5. When the drain pan 18 is housed in the casing 5 such that the frame portion 82*c* is located closer to the second side 5*c* of the casing 5, either of the first drain socket 16*a* and the second drain socket 16*b* can be chosen as a drain port. In addition, when the drain pan 18 is housed in the casing 5 such that the frame portion 82*a* is located closer to the second side 5*c* of the casing 5, either of the third drain socket 16*c* and the fourth drain socket 16*d* can be chosen as a drain port. In this manner, an operator can choose a drain port from the first drain socket 16*a* to the fourth drain socket 16*d* of the first side 5*b* to the fourth side 5*e*.

Figure 12:
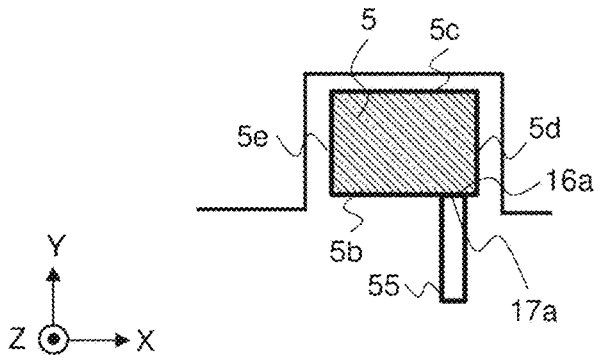
FIG. 12 is a layout illustrating an example in which the relay unit according to Embodiment 3 is installed.

Next, an example in which the relay unit 4 is installed beside walls will be described. FIG. 12 is a layout illustrating an example in which the relay unit according to Embodiment 3 is installed. FIG. 12 illustrates an example in which the second side 5*c*, the third side 5*d*, and the fourth side 5*e* are surrounded by walls with the first side 5*b* located beside an open space. In this example, an operator houses the drain pan 18 in the casing 5 as illustrated in FIG. 7 and can then connect a drain hose 55 to the first drain port 17*a* and the first drain socket 16*a* as illustrated in FIG. 12.

Figure 13:
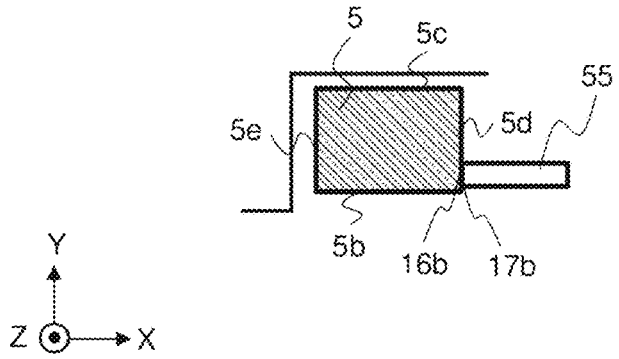
FIG. 13 is a layout illustrating another example in which the relay unit according to Embodiment 3 is installed.

FIG. 13 is a layout illustrating another example in which the relay unit according to Embodiment 3 is installed. FIG. 13 illustrates an example in which the second side 5*c* and the fourth side 5*e* are surrounded by walls with the first side 5*b* and the third side 5*d* located beside an open space. An operator houses the drain pan 18 in the casing 5 as illustrated in FIG. 7 and then connects the drain hose 55 to the second drain port 17*b* and the second drain socket 16*b* as illustrated in FIG. 13. In this example, it is possible to make space for maintenance in front of the first side 5*b* of the casing 5.

Figure 14:
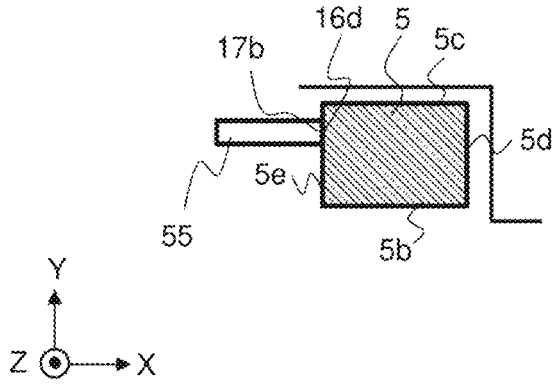
FIG. 14 is a layout illustrating still another example in which the relay unit according to Embodiment 3 is installed.

FIG. 14 is a layout illustrating still another example in which the relay unit according to Embodiment 3 is installed. FIG. 14 illustrates an example in which the second side 5*c* and the third side 5*d* are surrounded by walls with the first side 5*b* and the fourth side 5*e* located beside an open space. An operator houses the drain pan 18 in the casing 5 such that the frame portion 82*a* illustrated in FIG. 10 of the drain pan 18 is located closer to the second side 5*c* and then connects the drain hose 55 to the second drain port 17*b* and the fourth drain socket 16*d* as illustrated in FIG. 14. In this example, it is possible to make space for maintenance in front of the first side 5*b* of the casing 5.

In this manner, even when the casing 5 is installed beside walls, an operator can choose a port for the drain hose 55 according to the layout of walls and a maintenance area, for example.

The relay unit 4 in Embodiment 3 includes the drain pan 18, which is configured to store dew condensation water and to be slid and drawn out from the casing 5. Thus, the drain pan 18 is easy to clean. In addition, in Embodiment 3, a port for the drain hose 55 is provided in each of the first side 5*b* to the fourth side Se of the relay unit 4, and drain ports are provided in two parts of the drain pan 18. When an operator houses the drain pan 18 in the casing 5, the operator can choose between two orientations of the drain pan 18 to be inserted into the casing 5 and choose, from four sides, that is, the first side 5*b* to the fourth side 5*e*, a surface to which the drain hose 55 is attached.

In Embodiment 3, a surface to which the drain hose 55 is attached can be chosen from four sides, that is, the first side 5*b* to the fourth side 5*e*. Thus, even when the relay unit 4 is installed beside walls, it is possible to attach the drain hose 55 to the relay unit 4 as long as a side located beside an open space is included in the four sides.

In addition, in Embodiment 3, two drain ports are provided in the drain pan 18. Thus, one of the two drain ports can be used as a regular drain port, and the other of the two drain ports can be used as an emergency drain port.

Embodiment 4

In Embodiment 4, the relay unit 4 described in Embodiment 3 is formed to include a drain pan whose configuration is different. In Embodiment 4, the same components as those described in Embodiments 1 to 3 have the same reference signs, and detailed descriptions thereof are omitted.

Figure 15:
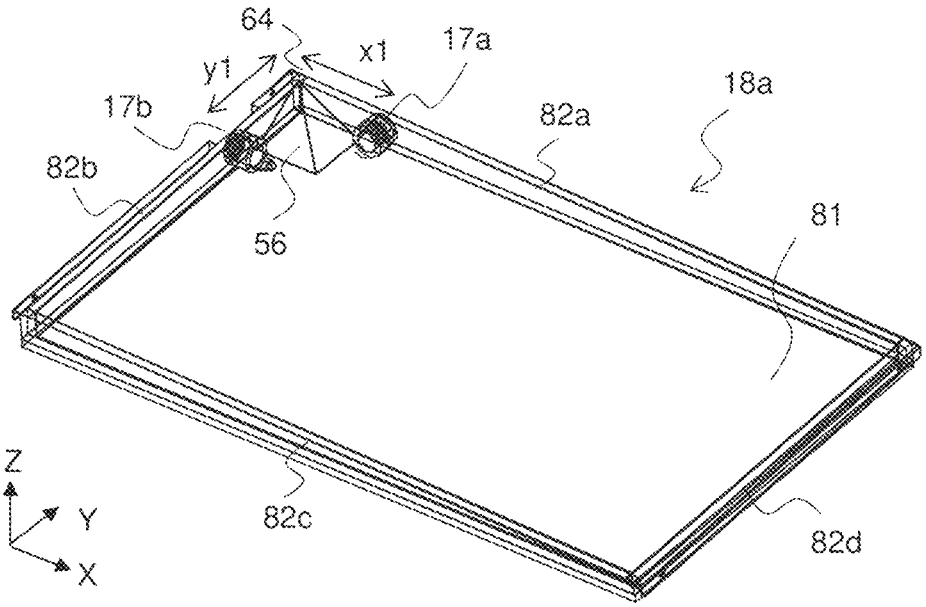
FIG. 15 is an external perspective view illustrating a configuration example of a drain pan to be provided in a relay unit according to Embodiment 4.

The configuration of a drain pan to be provided in the relay unit 4 in Embodiment 4 will be described. Other than the drain pan, the relay unit 4 in Embodiment 4 has a configuration similar to that described in Embodiment 3, and detailed descriptions thereof are thus omitted. FIG. 15 is an external perspective view illustrating a configuration example of a drain pan to be provided in a relay unit according to Embodiment 4.

A drain pan 18*a* includes the plate 81 and the four frame portions 82*a* to 82*d*, which are provided around the plate 81. Of the two frame portions 82*a* and 82*b*, the first drain port 17*a* is formed at the position in one frame portion, that is, the frame portion 82*a*, at the first distance x1 from the second edge 64, where the two frame portions 82*a* and 82*b* are in contact with each other, and the second drain port 17*b* is formed at the position in the other frame portion, that is, the frame portion 82*b*, at the second distance y1 from the second edge 64.

A projection 56 is provided, between the first drain port 17*a* and the second drain port 17*b*, at a corner portion on the plate 81 where the second edge 64 is formed. In the configuration example illustrated in FIG. 15, the projection 56 is a quadrangular pyramid whose bottom surface is formed by two sides extending for the first distance x1 and two sides extending for the second distance y1. Since the shape of the projection 56 is a quadrangular pyramid, dew condensation water formed on the periphery of the corner portion can easily flow, in directions toward the first drain port 17*a* and the second drain port 17*b*, along inclined surfaces of the quadrangular pyramid.

In the drain pan 18*a* illustrated in FIG. 15, the projection 56 is provided at the corner portion where the second edge 64 is formed. Thus, it is possible to prevent water collected on the plate 81 from remaining at the corner portion. In addition, even when one of the first drain port 17*a* and the second drain port 17*b* is closed, water collected on the plate 81 is discharged, along the projection 56, to the outside from the other thereof that is open.

In the relay unit 4 in Embodiment 4, the projection 56 is provided, between the first drain port 17*a* and the second drain port 17*b*, at the corner portion on the plate 81 of the drain pan 18*a* where the second edge 64 is formed. Thus, even when one of the two drain ports is closed, water collected on the plate 81 is discharged, along the projection 56, to the outside from the other thereof that is open. As a result, dew condensation water does not remain at the corner portion of the drain pan 18*a* Water does not remain at the corner portion of the drain pan 18*a*, thus inhibiting production of foreign matter such as dust and slime that causes clogging of a drain port. In addition, this structure is a structure in which water is unlikely to be collected in the drain pan 18*a* and can thus reduce rusting and water leakage.

REFERENCE SIGNS LIST

1: air-conditioning apparatus, 2: heat source side unit, 3*a* to 3*f*: load side unit, 4: relay unit, 5: casing, 5*a*: top surface, 5*b*: first side, 5*c*: second side, 5*d*: third side, 5*e*: fourth side, 5*f*: bottom surface, 6: first refrigerant pipe connection port, 7: second refrigerant pipe connection port, 8*a* to 8*f*: first heat medium pipe connection port, 9*a* to 9*f*: second heat medium pipe connection port, 10: heat medium pipe connection port, 11: refrigerant pipe connection port, 12: first opening, 13: second opening, 14*a* to 14*f*: air purge valve, 15: on-off valve, 16*a*: first drain socket, 16*b*: second drain socket, 16*c*: third drain socket, 16*d*: fourth drain socket, 17*a*: first drain port, 17*b*: second drain port, 18, 18*a*: drain pan, 20: controller, 21: compressor, 22: heat source side heat exchanger, 23: four-way valve, 24: accumulator, 25: expansion valve, 26: refrigerant pipe, 31*a* to 31*f*: load side heat exchanger, 32*a* to 32*f*: heat medium pipe, 33*a* to 33*f*: heat medium pipe, 35: heat medium pipe, 41: pump, 42: heat medium heat exchanger, 44*a* to 44*f*: flow control valve, 45: refrigerant pipe, 46: heat medium pipe, 50: drawer panel, 51: refrigerant pipe, 55: drain hose, 56: projection, 61: first edge, 62: vertex, 64: second edge, 65: third edge, 66: fourth edge, 67: centroid, 71: power supply line, 72: transmission line, 73: cable tie, 81: plate, 82*a* to 82*d*: frame portion, 101: air

The invention claimed is:

1. A relay unit to be connected between a heat source side unit and a load side unit, the relay unit comprising:

a heat medium heat exchanger that is to be connected to the heat source side unit via refrigerant pipes and that is to be connected to the load side unit via heat medium pipes;

a casing containing the heat medium heat exchanger;

a first refrigerant pipe connection port to be connected to one of the refrigerant pipes, the refrigerant pipes including a refrigerant pipe through which refrigerant flows from the heat source side unit into the heat medium heat exchanger and a refrigerant pipe through which the refrigerant flows out from the heat medium heat exchanger into the heat source side unit;

a second refrigerant pipe connection port to be connected to an other of the refrigerant pipes;

a first heat medium pipe connection port to be connected to one of the heat medium pipes, the heat medium pipes including a heat medium pipe through which a heat medium flows from the load side unit into the heat medium heat exchanger and a heat medium pipe through which the heat medium flows out from the heat medium heat exchanger into the load side unit; and a second heat medium pipe connection port to be connected to an other of the heat medium pipes, wherein the first refrigerant pipe connection port, the second refrigerant pipe connection port, the first heat medium pipe connection port, and the second heat medium pipe connection port are provided on a top surface of the casing and face in a direction opposite to a direction of gravity, the casing has a cuboid shape and has the top surface, a first side, a second side facing the first side, a third side adjacent to the first side and the second side, a fourth side facing the third side, and a bottom surface facing the top surface, the first heat medium pipe connection port is provided closer to the first side, the second heat medium pipe connection port is provided closer to the second side, and a height of the first heat medium pipe connection port is lower than a height of the second heat medium pipe connection port.

2. The relay unit of claim 1, further comprising:

a plurality of first heat medium pipe connection ports, each of which is the first heat medium pipe connection port; and a plurality of second heat medium pipe connection ports, each of which is the second heat medium pipe connection port, wherein the plurality of first heat medium pipe connection ports are disposed to be spaced and to be parallel to a first edge where the top surface and the first side are in contact with each other, the plurality of second heat medium pipe connection ports are disposed to be spaced and to be parallel to the first edge, and positions where the plurality of second heat medium pipe connection ports are disposed are shifted, in a direction along the first edge, from positions where the plurality of first heat medium pipe connection ports are disposed.

3. The relay unit of claim 2, wherein an air purge valve is provided above each of the plurality of second heat medium pipe connection ports, and an on-off valve is provided at a part closer to the first side of each of the plurality of second heat medium pipe connection ports.

4. The relay unit of claim 1, wherein a drain pan is provided above the bottom surface, the drain pan includes a plate having a rectangular shape corresponding to a shape of the bottom surface, and four frame portions provided around the plate, a first drain port is formed at a position in one of two frame portions adjacent to each other of the four frame portions at a first distance from a second edge where the two frame portions adjacent to each other are in contact with each other, a second drain port is formed at a position in an other of the two frame portions adjacent to each other at a second distance from the second edge, in the casing, a first drain socket is formed at a position in the first side of the casing at the first distance from a third edge where the first side and the third side are in contact with each other, the position in the first side being located at a height where the drain pan is disposed, a second drain socket is formed at a position in the third side of the casing at the second distance from the third edge, the position in the third side being located at the height where the drain pan is disposed, a third drain socket is formed at a position in the second side of the casing, the position in the second side and the position of the first drain socket being symmetrical relative to a centroid of the bottom surface as a symmetry center point, and a fourth drain socket is formed at a position in the fourth side of the casing, the position in the fourth side and the position of the second drain socket being symmetrical relative to the centroid of the bottom surface as a symmetry center point.

5. The relay unit of claim 4, wherein a projection is provided, between the first drain port and the second drain port, at a corner portion on the plate where the second edge is formed.

6. The relay unit of claim 5, wherein the projection is a quadrangular pyramid whose bottom surface is formed by two sides each having a length equal to the first distance and two sides each having a length equal to the second distance.

7. The relay unit of claim 1, further comprising a power supply line extending from an inside of the casing via a first opening formed in the top surface of the casing.

8. The relay unit of claim 1, further comprising a transmission line extending from the inside of the casing via a second opening formed in the top surface of the casing.

9. An air-conditioning apparatus comprising:

a heat source side unit configured to generate a heat source;

a load side unit configured to use the heat source generated by the heat source side unit; and the relay unit of claim 1.

* * * * *